US011193295B1

(12) United States Patent
Proctor et al.

(10) Patent No.: US 11,193,295 B1
(45) Date of Patent: Dec. 7, 2021

(54) SHRINKAGE COMPENSATING DEVICE FOR SEISMIC RESTRAINT

(71) Applicants: Richard Proctor, San Rafael, CA (US); Robert G. Rodgers, Carmichael, CA (US)

(72) Inventors: Richard Proctor, San Rafael, CA (US); Robert G. Rodgers, Carmichael, CA (US)

( * ) Notice: Subject to any disclaimer, the term of this patent is extended or adjusted under 35 U.S.C. 154(b) by 0 days.

(21) Appl. No.: 16/994,285

(22) Filed: Aug. 14, 2020

Related U.S. Application Data

(60) Provisional application No. 62/888,294, filed on Aug. 16, 2019.

(51) Int. Cl.
*E04H 9/02* (2006.01)
*E04B 1/26* (2006.01)
*E04B 1/35* (2006.01)

(52) U.S. Cl.
CPC ..... *E04H 9/021* (2013.01); *E04B 2001/2688* (2013.01); *E04B 2001/3583* (2013.01)

(58) Field of Classification Search
CPC ..... E04H 9/021; E04B 2001/2688; E04B 2001/3583
See application file for complete search history.

(56) References Cited

U.S. PATENT DOCUMENTS

| | | | | |
|---|---|---|---|---|
| 6,951,078 | B2 * | 10/2005 | Espinosa | F16B 37/00 52/23 |
| 7,509,778 | B2 * | 3/2009 | Leek | E04B 1/0007 411/231 |
| 7,516,582 | B2 * | 4/2009 | Leek | E04B 1/0007 411/231 |
| 7,905,066 | B2 * | 3/2011 | Pryor | E04B 1/26 52/223.14 |
| 8,136,318 | B2 * | 3/2012 | Espinosa | E04H 9/14 52/293.3 |
| 8,511,019 | B2 * | 8/2013 | Espinosa | E04H 9/14 52/293.3 |
| 8,881,478 | B2 | 11/2014 | Simpson | |
| 10,605,284 | B2 * | 3/2020 | Taneichi | E04B 1/2604 |
| 2016/0244960 | A1 * | 8/2016 | Espinosa | E04H 9/14 |

* cited by examiner

*Primary Examiner* — Andrew J Triggs
(74) *Attorney, Agent, or Firm* — Thomas M. Freiburger

(57) ABSTRACT

A shrinkage compensating device for seismic restraint in wood building construction combines a spring-operated take-up device (TUD) with a ratcheting split nut. The split nut, attached to or formed as part of a rotatable component of the TUD, acts as the securing nut for the TUD and allows the TUD with the split nut to be slipped over the top of a threaded rod and pulled down along the rod into place against a structural member. Several forms of attachment of the split nut to the spring-operated TUD are disclosed, as is a simplified rotatable split nut version.

5 Claims, 7 Drawing Sheets

SHRINKAGE COMPENSATING DEVICE FOR SEISMIC RESTRAINT

This application claims benefit from provisional application Ser. No. 62/888,294, filed Aug. 16, 2019.

BACKGROUND OF THE INVENTION

This invention is concerned with shrinkage compensating devices for seismic restraint systems in wood building construction. The invention encompasses improvements on spring-operated shrinkage compensation devices.

Several types of spring-operated takeup devices for shrinkage compensation have been in use in wood building construction. Such takeup devices or TUDs are used above a horizontal top plate in a wood-frame building, in a seismic restraint system wherein tension is applied via a threaded rod through the height of several floors. The TUDs are installed to ensure that framing connections remain tight via the seismic restraint system through the years, despite shrinkage that occurs over time in wood structural components.

One typical configuration of a spring-activated TUD is in the form of two steel cylinders threaded together, one being inside the other and connected by male and female threads.

Usually the outer, larger-diameter cylindrical component is engaged down against a metal bearing plate that bears down against the wooden top plate of the framing. The inner cylinder extends slightly out the top of the outer cylinder and a threaded seismic restraint rod, which can be multi-story in length, extends through the top plate and up through the TUD, i.e. through the inner cylinder, extending out above the TUD. A threaded nut on the rod is tightened to bear down against the inner cylinder, usually with a washer or small bearing plate between the nut and the top of the inner cylinder. A coil spring is tightly wound and connected to the two cylinders in a way tending to cause relative rotation of the cylinders, rotating the inner cylinder along the threads so as to extend upwardly and outwardly from the outer cylinder. The threads are typically reverse threads if the spring is arranged to turn the inner cylinder clockwise relative to the outer cylinder, so that the spring will tend to extend the inner cylinder, rather than retract it further into the outer cylinder. Thus, if the wound spring coils run clockwise from top to bottom the threads should be reverse threads. Clockwise rotation of the extending cylinder is preferred, because this rotation can tend to rotate the nut above the TUD, and any rotation will be in the direction to tighten the nut, not loosen it.

Relative rotation of the two cylinders of the TUD is prevented until the TUD is installed, by an activation pin that extends through small aligned holes in the inner and outer cylinders. Once the TUD has been installed and the nut over the top plate tightened down, the activation pin is pulled and the tightly wound coil spring applies torque to the inner cylinder, i.e. torque between the two cylinders, tending to expand the height of the TUD.

The wound coil spring can be inside or outside the TUD, and it is possible to have either the inner cylinder or the outer cylinder bearing down against the top plate, i.e. either the inner or the outer cylinder can be the moving part.

Another type of shrinkage compensating device for seismic restraint systems in wood construction is a split nut, also called a ratcheting takeup device (ratcheting TUD). One type of ratcheting takeup device is shown in U.S. Pat. No. 8,881,478, owned by Simpson Strong-Tie Company of Pleasanton, Calif. A split nut is a known mechanical device in which the circumference of a nut is split into two or more sections, the split being along one or more planes along the axis of the nut. Typically the nut is in four sections. The base of the nut is tapered, and the nut resides in a confining saddle or housing that tapers inwardly generally as the nut tapers. Thus, a downward force on the nut will close the nut sections together, but an upward force imposed by a threaded rod engaged in the nut will tend to spread the sections, allowing the nut to be slidable down the length of a rod in a ratcheting fashion. The threads have angled surfaces so that they can slide down along the threads of the rod, spreading apart as they step down one thread at a time. Thus, the nut can be slid down the rod without rotation, but it cannot be moved up the rod by sliding.

Such a ratcheting takeup device has form of a spring or resilient force-exerting member, such as a rubber or elastomeric washer that acts within the housing to urge the nut sections down in the housing toward the close together position. When a ratcheting takeup device is slid down a threaded rod, the spring or elastomeric ring is compressed with each ratcheting step over the threads.

The split nut TUD, or ratcheting TUD, can be used as a simple form of shrinkage compensator in seismic restraint systems in wood construction. Normally a steel bearing plate or washer is set against the top surface of the wood top plate, then the ratcheting TUD is slid down over the top of the threaded rod and the housing placed against the steel bearing plate. Typically the TUD housing and the steel bearing plate below are nailed into position on the wood top plate. With shrinkage over time, the height of the wood frame construction shrinks somewhat, such that the threaded rod protrudes upwardly to a greater extent through the TUD. The rod thus ratchets its way through the split nut, the shrinkage being taken up thread by thread, with no rotation of the TUD or the rod.

The described ratcheting takeup device is somewhat effective, but it does not maintain as tight a connection in the framing as is the case where rotation of threads takes place, as in the spring-activated TUD described above. The spring-activated TUD can maintain tension in the threaded connecting rod, as a strong coil spring constantly urges full takeup of any shrinkage. In the case of the ratcheting device, however, there is no tightening force and some play remains, especially when the split nut is progressing (slowly) over a thread and has not snapped into place.

It is an object of the invention to combine the spring-activation and the ratcheting split nut principles embraced by the two types of TUDs described above, enabling a spring-activated TUD to be slid down over a threaded rod in ratcheting fashion, with constant restraint force maintained over time.

SUMMARY OF THE INVENTION

With the current invention the advantages of a spring-activated TUD and a ratcheting, split nut TUD are combined. The housing of a split nut is attached to the upper end of the spring-operated TUD such that the ratcheting TUD with split nut can be slipped over the top of a threaded rod and pulled down the rod in ratcheting fashion, into place against a structural member such as a wood top plate. In this way, slack inherent in placement of a split nut, and in operation during shrinkage over the years, is taken up by relative rotation of the cylindrical components of the spring-operated TUD and the resulting expansion of the TUD. When the TUD's activation pin is disengaged after installation of the combined TUD, this causes a small rotation of the split nut on the rod, so that the split nut is caused to engage fully with the thread of the threaded rod. The threads of the split nut remain in this position, fully engaged with the rod threads, and shrinkage of wood components is taken up by the relative rotation in the cylindrical components.

The split nut can be secured to the spring-operated TUD in several different ways. In a preferred form of the invention the TUD cylinder that moves upward with rotation (which can be either the inner cylinder or the outer cylinder) has an upper end that forms an integrated housing for the split nut. The split nut housing and the split nut itself can be generally as shown in U.S. Pat. No. 8,881,478, or it can be in accordance with other conventional split nut construction, typically with two, three or four segments. The split nut will rotate with the rotating cylindrical component as well as tending to rise slightly and thus, by removal of the activation pin, the threads of the split nut and the rod will immediately snap into registry if not there already on placement of the device. With future shrinkage the threads will remain in full registry. The positive connection between the spring-activated TUD and the split nut, engaging the threaded rod, assures that any rotation of the expanding cylinder with shrinkage will take up the shrinkage by nut rotation as well as by rising of the cylinder.

Other means of connection of the split nut to the double-cylinder spring-activated TUD can be used. Any form of connection between the upper end of the double-cylinder TUD and the split nut housing is possible, as long as the nut housing is affixed to the moving cylinder of the TUD below. The combined device should act as a single unit when installed, so that a worker can simply pull the device down over the threaded rod, ratcheting the device down into place, before pulling the activation pin. The connection should retain the split nut against axial separation from the double-cylinder TUD and also against relative rotation.

Note that the two cylinders, typically threaded together (with a reverse thread) in a spring-activated TUD, need not be threaded together but only relatively rotational. If the cylinder to which the split nut is secured rotates with the action of the coil spring, this will rotate the split nut and cause the desired tightening down on the rod. Expansion between the two cylinders would not occur, but the threaded rotation of the split nut down the threaded rod will take up shrinkage.

In another, simpler embodiment, a split nut assembly is simply mounted in a seat for rotation within the seat, which is to be fixed down to a wood top plate. A wound coil spring, when released, tends to rotate the split nut assembly in the clockwise direction as viewed from above, so that the split nut advances down the threaded rod as shrinkage occurs, taking up the shrinkage.

The invention makes installation of a TUD simpler and faster, eliminating the need to spin a nut down the upper end of a connecting rod, which is sometimes a considerable distance, while also eliminating "slack" of a ratcheting split-nut TUD. These and other objects, advantages and features of the invention will be apparent from the following description of a preferred embodiment, considered along with the accompanying drawings.

DESCRIPTION OF PREFERRED EMBODIMENTS

Figure 1:
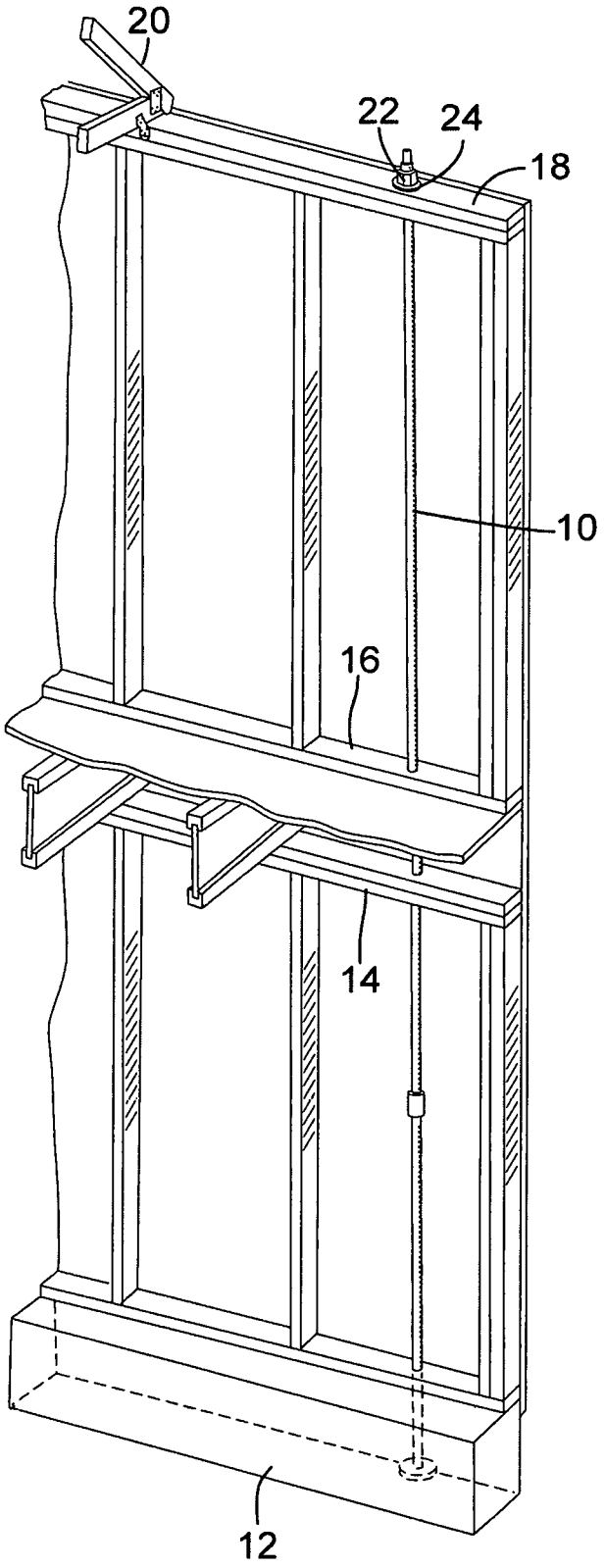
FIG. 1 PRIOR ART
FIG. 1 is an elevation view, partially in perspective, showing a typical framing situation in a multiple-story building, with a seismic restraint in the form of a long vertical connecting rod, in accordance with prior art.

In the drawings, FIG. 1 schematically shows an installation of a seismic restraint rod 10 in a multi-story wood-frame building. The lengthy vertical threaded rod 10 is fixed into the building's foundation 12 and extends up through ceiling and top plates 14 and 16 at the top of a first floor and up to a connection with a top plate 18 at the roof level. Roof rafters 20 are indicated in the drawing. The restraint rod 10 extends through holes in the various plates 14, 16 and 18, and a nut 22 is tightened down on the rod at the top end, with a washer or metal plate 24 bearing against the upper side of the top plate 18.

Figure 3:
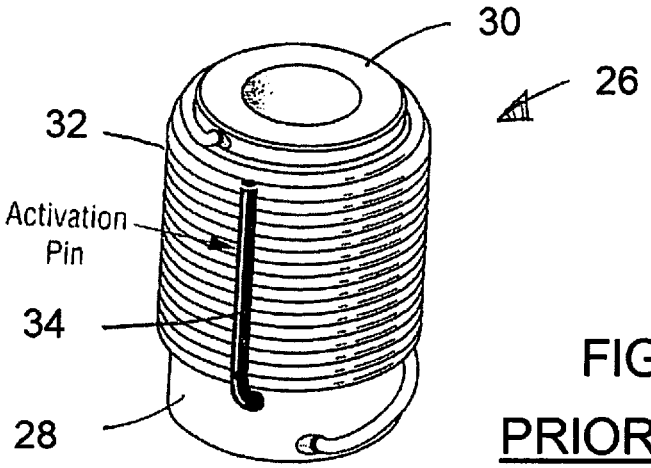
FIG. 3 PRIOR ART
FIG. 3 is a perspective view showing a spring-actuated TUD as in the prior art.
Figure 2:
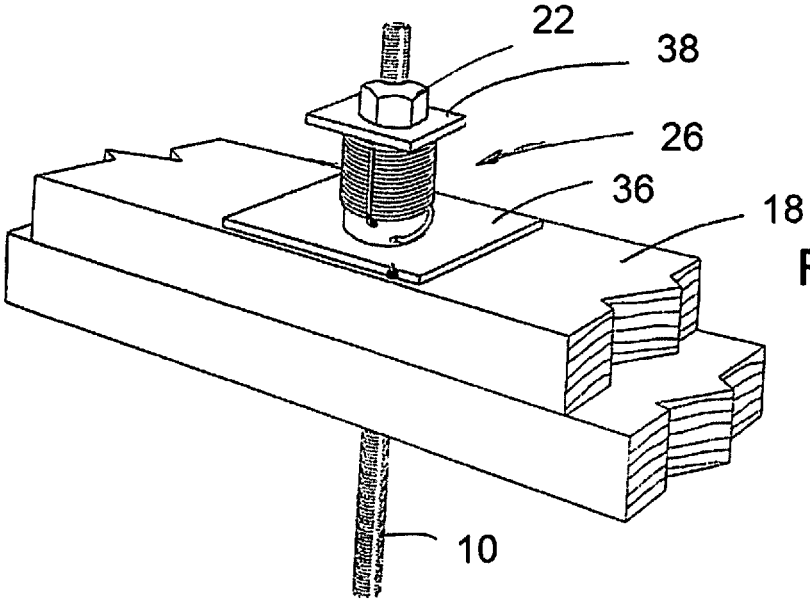
FIG. 2 PRIOR ART
FIG. 2 is a perspective view showing a prior art installation of a spring-activated TUD and seismic restraint system such as in FIG. 1.

As is well known, the problem with such seismic restraint systems is that wood structural members shrink over time, particularly in width or thickness dimensions. Thus, take up devices or TUDs have been developed to act dynamically to take up shrinkage in height, i.e. lessening of the distance from the foundation to the top plate. A spring actuated TUD 26 is shown in FIGS. 2 and 3, as known in the prior art. Such TUDs have an outer cylinder 28, an inner cylinder 30 rotatable within and connected by threads to the outer cylinder, and a tightly wound coil spring 32 that is restrained by an activation pin 34 until the TUD has been installed. As shown in FIG. 2, such a spring-actuated TUD 26 is used with a nut 22 to tighten the TUD down against the top plate on the threaded seismic restraint rod 10. Washers or bearing plates are typically used at 36 and 38, i.e. between the TUD and the wood top plate 18 and between the nut 22 and the upper end of the TUD 26. The pin 34 is pulled to release the coil spring and activate the TUD.

As the wood components shrink over time, such that their thickness dimensions decrease, the TUD 26 expands in length to take up the shrinkage. The threads between the inner and outer cylinders 28 and 30 of the TUD are reverse threads (sometimes called left-hand threads), so that the expanding rotation, caused by the released coil spring 32, rotates the upper cylinder (the inner cylinder in this case) in the clockwise direction as viewed from above. This is important in that if the rotating upper cylinder rotates the plate 38 and the nut 22, it will be in the direction of tightening the nut down on the rod 10, rather than the opposite direction which would negate the effect of the expanding TUD.

Figure 4:
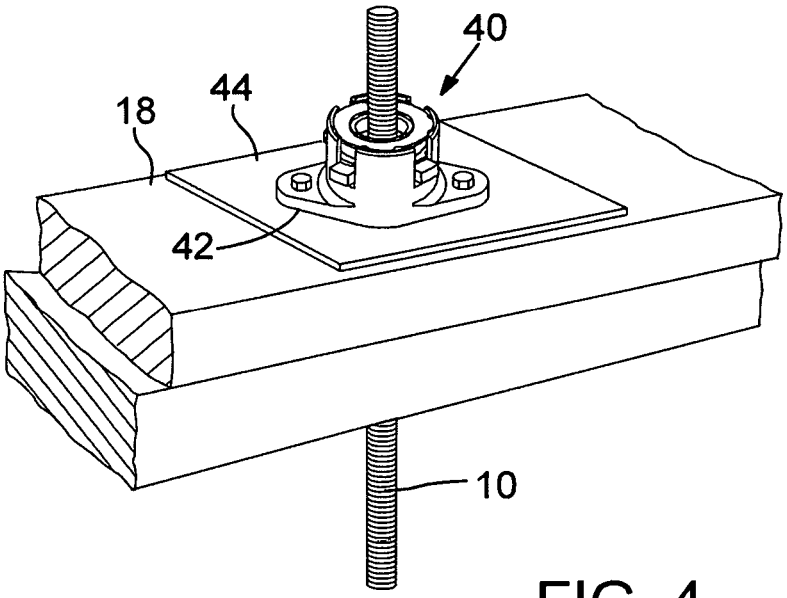
FIG. 4 PRIOR ART
FIG. 4 is a perspective view showing a split nut, ratcheting TUD as installed in a seismic restraint system as in prior art.
Figure 5:
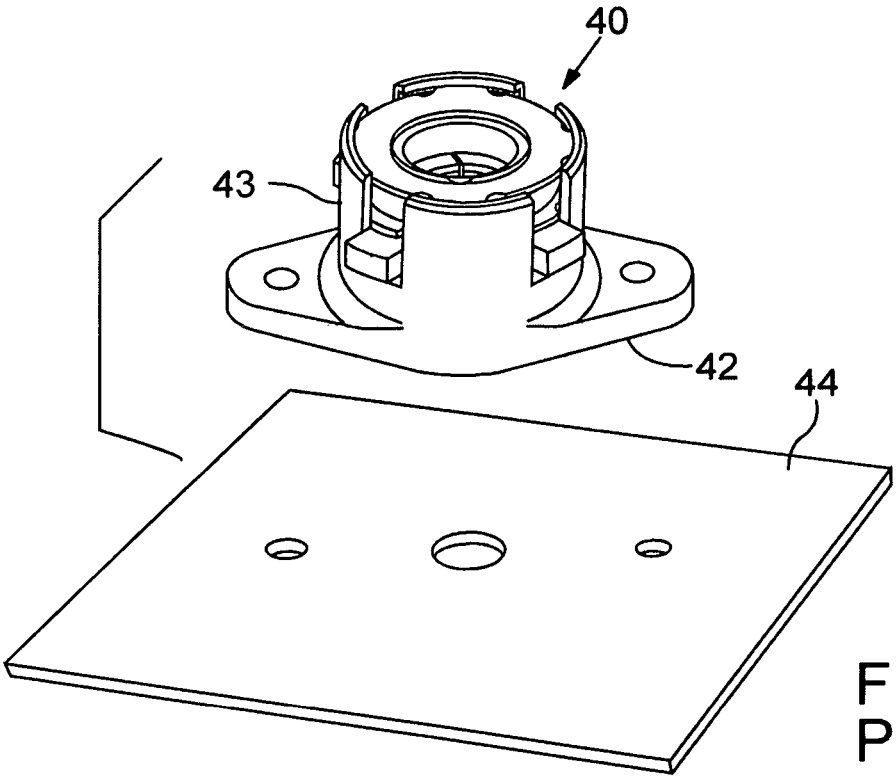
FIG. 5 PRIOR ART
FIG. 5 is a perspective view showing a prior art ratcheting split nut TUD in greater detail.

Another, simpler form of TUD for seismic restraint systems is shown in the prior art drawings of FIGS. 4 and 5. These drawings show a split nut ratcheting TUD 40, which can be structured as in U.S. Pat. No. 8,881,478 or as in other similar split nuts. Split nut sections are spring-biased down against a taper or saddle that forces them together to tighten on rod threads. Downward movement of the split nut (or upward movement of the threaded rod relative to the split nut) will cam the nut section upwardly and outwardly, allowing them to slip or ratchet up the rod, thread by thread. As shown in FIG. 4, the ratcheting TUD 40 is installed above a top plate 18 of a building, with its base 42 secured down to the top plate, such as by nails. A housing or casing 43 extends up from the base 42. A bearing plate 44 is also shown in FIGS. 4 and 5.

Sometimes the threaded seismic restraint rod 10 has considerable length above the plate 18, which may not always be a top plate. The advantage of the ratcheting TUD 40 is that it can be slipped over the top end of the rod 10 and simply pulled down, ratcheting its spring-loaded nut sections as it slips over the threads of the rod, rather than requiring screwing rotation down to the plate, as is required with a standard nut. Thus, it is quickly and easily installed. However, as discussed above, the ratcheting TUD does not maintain as tight a connection in the framing as is the case where rotation of a threaded connection takes place, as in the spring-actuated TUD described as reference to FIGS. 2 and 3. When the ratcheting TUD 40 is brought down to the plate and installed, its threads may be riding on top of the thread of the restraint rod 10, rather than being fully engaged, thus causing some slack. Over time, as shrinkage occurs, the rod will ratchet up through the TUD 40, slowly jumping over threads in the ratcheting fashion. Thus, there is almost always a slight bit of slack in the restraint system.

Figure 6:
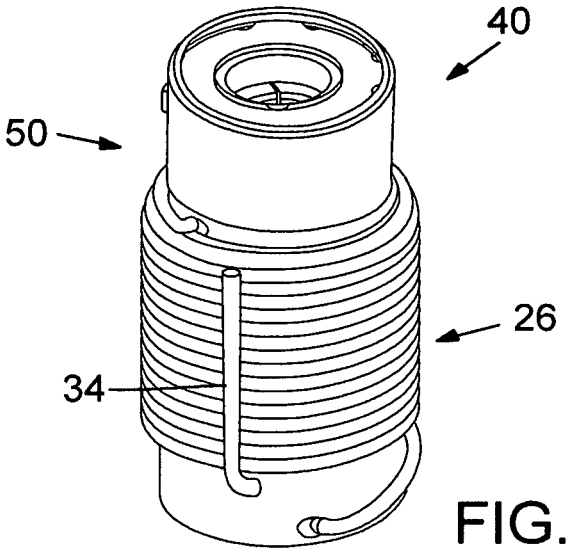
FIG. 6 is a perspective view showing an embodiment of the combined TUD of the invention.
Figure 7:
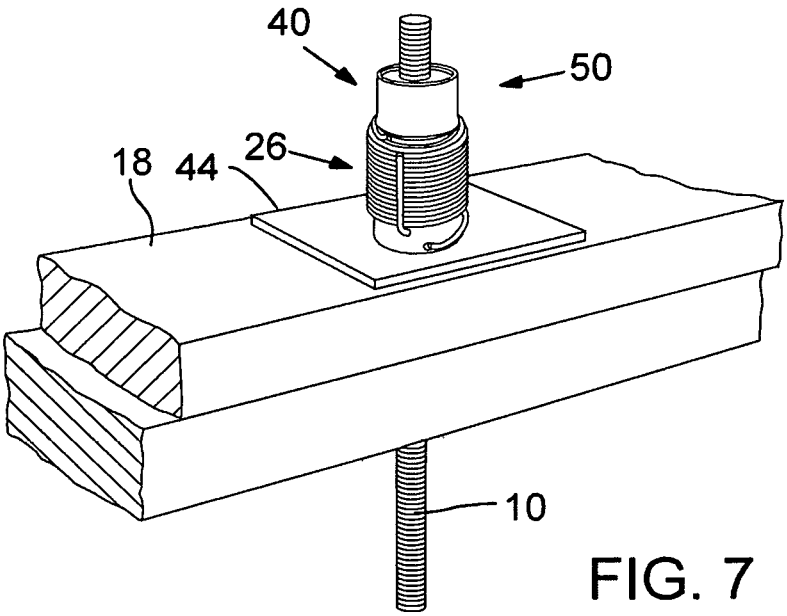
FIG. 7 is a perspective view showing the combined device of FIG. 6 in place in a seismic restraint system at the top plate of wood framing construction.

FIGS. 6 and 7 show a TUD 50 according to the invention. The novel TUD 50 combines a spring-activated expanding TUD structure with a split nut, so as to have the advantages of both, and providing for elimination of slack in the system. In FIGS. 6 and 7 a spring-actuated TUD 26 is combined with a ratcheting split nut TUD 40, with the upper component of the TUD 26 fixed to the housing 43 of the ratcheting TUD. In this case the inner threaded cylinder of the TUD 26 is the upper cylinder which is connected to the ratcheting TUD 40. When the activation pin 34 is removed after installation of the combined TUD 50, the inner cylinder of the TUD 26 will rotate in the clockwise direction and the ratcheting TUD 40 will rotate along with it.

FIG. 7 shows that on installation over a building's upper plate 18, the seismic restraint rod 10 has no separate nut above the TUD 50. Instead, the split nut ratcheting TUD 40 engages with the threads of the rod 10. The device is installed in the same way as a simple ratcheting split nut; it is pulled down over the restraint rod 10, ratcheting over the threads until it reaches the top plate 18, or a bearing plate 44 as shown. When thus moved into position, the split nut threads may not be fully engaged with the thread of the rod 10, i.e. the split nut threads will likely be riding on the ridges of rod threads, unless the installer assures the threads are fully engaged. Once the activation pin 34 is pulled, however, the upper cylinder and split nut device 40 will be rotated to a slight degree in the clockwise direction relative to the outer threaded cylinder of the device 26 and relative to the threaded rod 10, and the split nut/upper cylinder assembly will rise slightly. The threads will become fully engaged, with the device 50 positioned tightly against the upper plate 18. Note that the rotation of the split nut device 40 on the rod threads will be in the tightening direction, tightening the device down on the rod.

Figure 8:
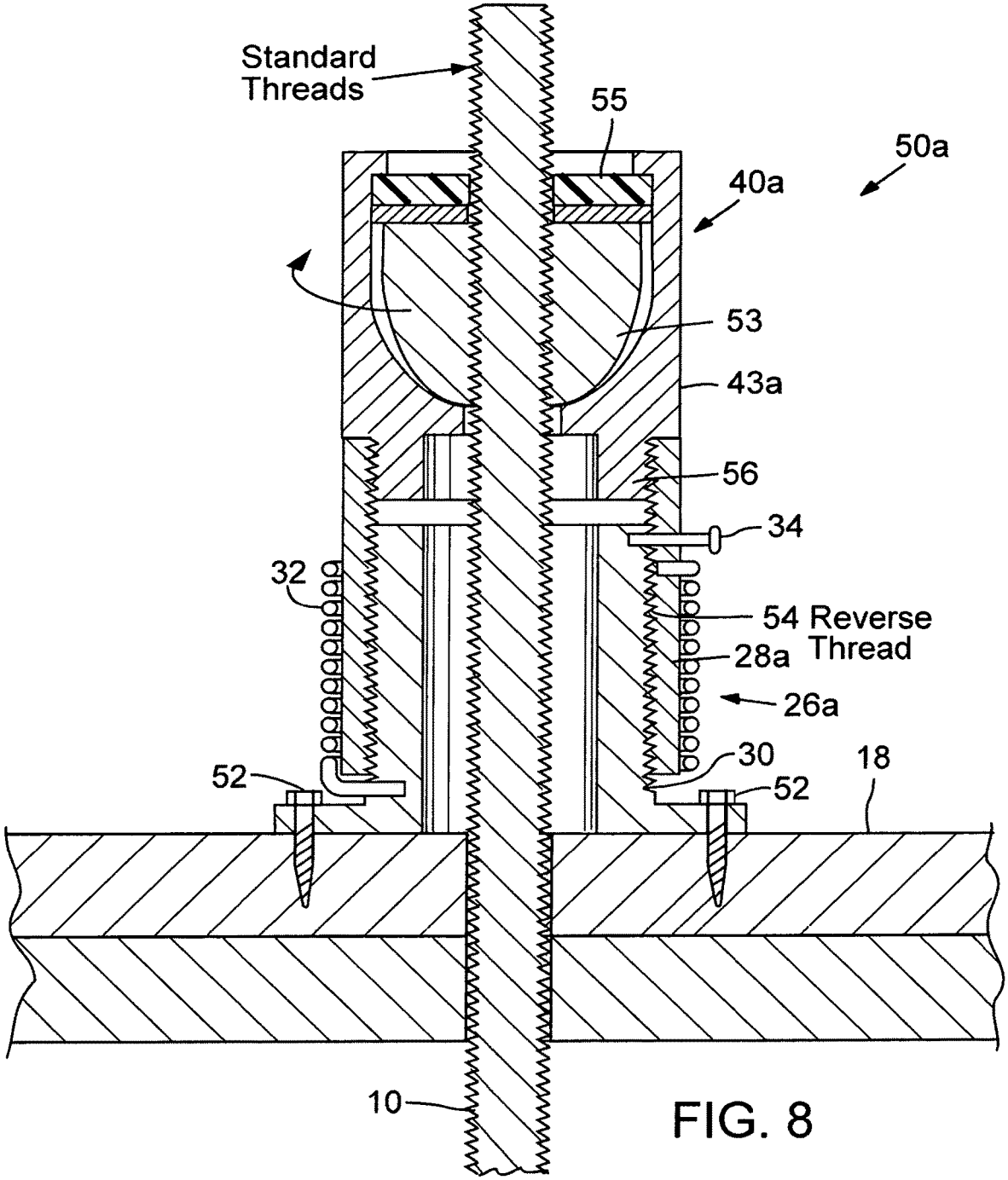
FIG. 8 is a sectional view showing one manner of connection of the ratcheting TUD to the spring-actuated two-cylinder base.

FIG. 8 illustrates one preferred manner of connection of the spring-activated TUD device 26 to the split nut ratcheting device 40. Although the components could be connected together in any manner that assures movement of the ratcheting split nut 40 together with the upper cylinder of the component 26 (which could either be the inner cylinder or the outer cylinder), FIG. 8 illustrates one efficient manner of connection. In this case the inner cylinder 30 of the spring-activated TUD device **26*a* bears down against the top plate 18, which can be via a bearing plate (not shown). The combined TUD device 50*a* can be secured by fasteners (such as nails) to the plate 18, as indicated at 52**.

It is the outer cylinder **28*a* that is movable relative to the fixed inner cylinder in the example of a combined device 50*a* shown in FIG. 8. The coil spring 32, when released by removal of the activation pin, rotates the outer cylinder 28*a* clockwise (as seen from above) relative to the inner cylinder 30, and since the threads 54 between the cylinders are reverse threads, this causes the outer cylinder 28*a* to rise. A split nut housing or casing 43*a* is threaded into the outer cylinder 28*a* to make the connection, the casing or housing 43*a* having a depending annular flange 56 with a reverse male thread. Nut segments are shown at 53 and a spring or spring bushing at 55. Since the threads of the flange 56 are reverse or left-hand threads, the turning of the outer cylinder 28*a* in the clockwise direction will tighten the outer cylinder further against the split nut housing 43*a*, rather than tending to disengage the two components. Thus, the reverse threads of the combined TUD device 50*a* serve dual purposes of fastening the components 28*a* and 43*a* together, with spring force acting to further tighten the connection, and that of cooperating with the inner cylinder 30** to expand the two-cylinder device when shrinkage occurs.

As described above, the expansion of the two-cylinder TUD portion will also tend to cause the threads of the split nut device to move fully into registry with the threads of the seismic restraint rod 10 (if they are not already in registry), on initial deployment of the device.

Further, as discussed above, the combined TUD device **50*a* works to take up shrinkage in two ways: by the axial upward movement caused by rotational interaction of the threads 54 between the cylinders; and by actually rotating the split nut device 40*a* in a direction that will tighten the split nut down on the threaded rod 10**. Two different relative thread rotations act to take up shrinkage.

In a modified embodiment of the invention, not shown, the threads 54 between the cylinders can simply be eliminated, with provision for the outer cylinder to be rotatable relative to the inner cylinder. The split nut housing or casing **43*a* can be secured in a non-rotatable connection to the outer cylinder in any desired manner, such as one or more pins extending through aligned holes in the two components, or by notches in one and tabs in the other, to engage in the notches to prevent relative rotation. They could be connected together by any appropriate form of fastener, as could the embodiments shown in FIGS. 7 and 8. What is important is that the split nut housing 43 rotate along with the outer cylinder (the movable cylinder), and that the outer cylinder be rotatable relative to the inner cylinder or base component. Such a non-threaded embodiment will not include axial expansion for taking up shrinkage, but will rely on rotation of the split nut on the threads of the rod 10 for tightening the device 50*a*** down on the rod as shrinkage occurs.

They could be connected together by any appropriate form of fastener, as could the embodiments shown in FIGS. 7 and 8. What is important is that the split nut housing 43 rotate along with the outer cylinder (the movable cylinder), and that the outer cylinder be rotatable relative to the inner cylinder or base component. Such a non-threaded embodiment will not include axial expansion for taking up shrinkage, but will rely on rotation of the split nut on the threads of the rod 10 for tightening the device 50*a* down on the rod as shrinkage occurs.

Figure 9:
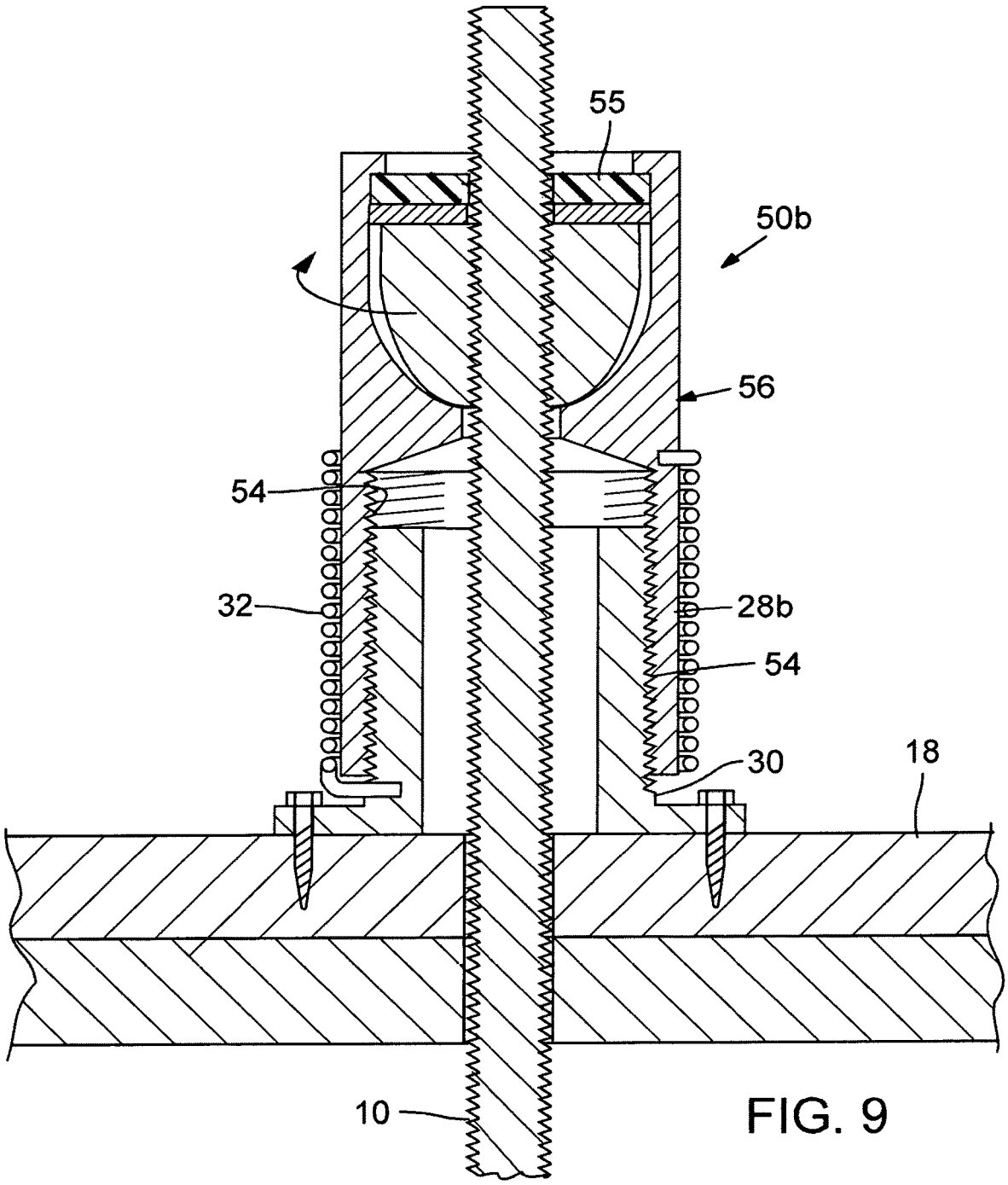
FIG. 9 is a sectional view showing a modification of the combined TUD, wherein the spring-actuated TUD and the split nut have an integral component.

FIG. 9 shows a modification of the device shown in FIG. 8. Here a combined TUD 50*b* operates in the same way as the TUD 50*a* of FIG. 8, but the outer cylinder and the split nut housing or casing are one integral component 56. Reverse threads 54 act between an inner cylinder 30 and an outer cylinder component 28*b* of the integral device 56. Again, this could be modified to eliminate threads between cylinders, permitting simple rotation.

Figure 10:
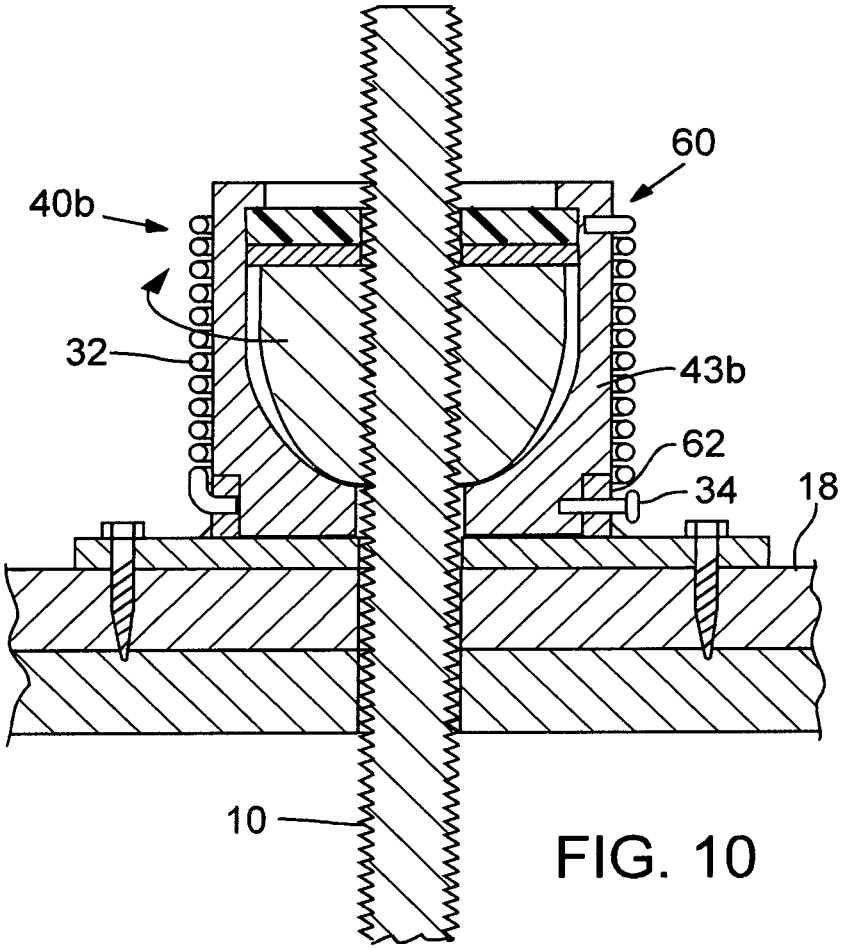
FIG. 10 is a sectional view showing another embodiment of the invention.

FIG. 10 shows a simplified version of a combined spring-activated, split nut ratcheting TUD 60. In this case the two relatively rotatable threaded cylinders are eliminated. A split nut ratcheting device 40*b* is simply rotatable within a base or seat 62 that could be secured down to a building's upper plate 18 as shown. The freely rotatable housing 43*b* of the split nut device 40*b* is rotatable under the influence of a coil spring 32, which is active when an activation pin 34 is pulled. Again, the spring urges the housing 43*b* in the clockwise direction as viewed from above, so that rotation of the device 60 causes the split nut to tighten down on the seismic restraint rod 10.

Installation of the TUD 60 is the same as described above, simply by slipping the device downwardly, ratcheting it over the threads of the rod 10 until the plate 18 is reached. As described earlier, this will result, more often than not, in the threads residing on ridges of rod threads, if thread engagement is not assured by the installer. This tends to be remedied, however, by release of the activation pin, causing sufficient rotation to firmly engage the threads. However, because of the strong force of the coiled torsion spring 32 and the potential for sudden rapid rotation of the split nut device, it is preferred that the installer be instructed to lower the TUD 60 almost to the plate 18, then to turn the TUD to tighten it down into place, so that the threads are firmly engaged before the base 62 is secured to the plate.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A shrinkage compensating device for seismic restraint in wood building construction, comprising:

a spring-operated take-up device (TUD) comprised of inner and outer cylinders threadedly engaged together and a coiled spring connected to the two cylinders so as to cause relative rotation of the two cylinders so that one cylinder tends to extend from the other due to rotation along threads when an activation pin is removed from the TUD, a split nut including a casing containing a plurality of internally threaded nut segments retained in a circular array in the casing, the nut segments being resiliently urged in an axial direction against inclined surfaces of the casing to urge the segments inwardly toward one another, allowing ratcheting movement of a threaded rod through the split nut in one direction only, and the split nut being attached to an upper end of the TUD such that the TUD with split nut can be slipped over the top of a threaded rod and pulled down the rod into place against a structural member, whereby slack inherent in placement of the split nut is taken up by relative rotation of the cylinders of the TUD and resulting expansion of the TUD when the TUD's activation pin is disengaged, so that the split nut engages fully with the thread of the threaded rod.

2. The shrinkage compensating device of claim 1, wherein the split nut is attached to the TUD by an integral, unitary connection between said one cylinder and the casing of the split nut.

3. The shrinkage compensating device of claim 1, wherein the split nut is attached to the TUD buy a threaded connection between the casing of the split nut and said one cylinder of the TUD.

4. The shrinkage compensating device of claim 3, wherein the threaded connection between the casing of the split nut and said one cylinder is a reverse thread.

5. The shrinkage compensating device of claim 4, wherein said one cylinder is the outer cylinder, the inner cylinder being adapted to engage against a component of wood building construction, and the inner and outer cylinders are threadedly engaged together via reverse threads, so that clockwise rotation of said one, outer cylinder relative to the inner cylinder causes the outer cylinder to extend from the inner cylinder, without tending to unscrew the split nut on a threaded rod with standard threads, and said one, outer cylinder has internal reverse threads for engagement with threads of both the inner cylinder and the casing of the split nut.

* * * * *